United States Patent [19]

Youtie

[11] Patent Number: 4,677,949

[45] Date of Patent: Jul. 7, 1987

[54] SCROLL TYPE FLUID DISPLACEMENT APPARATUS

[76] Inventor: Robert K. Youtie, 200 Uxbridge Ave., Cherry Hill, N.J. 08034

[21] Appl. No.: 767,114

[22] Filed: Aug. 19, 1985

[51] Int. Cl.[4] ..... F02B 53/00

[52] U.S. Cl. ..... 123/235; 418/55; 418/60

[58] Field of Search ..... 123/234, 235, 238; 418/5, 55, 60, 59

[56] References Cited

U.S. PATENT DOCUMENTS

| | | | |
|---|---|---|---|
| 801,182 | 10/1905 | Creux . | |
| 1,877,250 | 9/1932 | Meyer | 123/235 |
| 2,231,440 | 2/1941 | Fess | 123/247 |
| 3,817,664 | 6/1974 | Bennett et al. . | |
| 3,884,599 | 5/1975 | Young et al. . | |
| 3,994,635 | 11/1976 | McCullough . | |
| 3,994,636 | 11/1976 | McCullough et al. | 418/55 |
| 4,129,405 | 12/1978 | McCullough . | |
| 4,192,152 | 3/1980 | Armstrong et al. . | |
| 4,300,875 | 11/1981 | Fischer et al. . | |
| 4,343,599 | 8/1982 | Kousokabe . | |
| 4,484,869 | 11/1984 | Nakayama et al. . | |
| 4,490,099 | 12/1984 | Terauchi et al. . | |
| 4,497,615 | 2/1985 | Griffith . | |
| 4,505,651 | 3/1985 | Terauchi et al. . | |
| 4,515,539 | 5/1985 | Morishita . | |
| 4,550,480 | 11/1985 | Tanikawa et al. . | |
| 4,553,913 | 11/1985 | Morishita et al. | 418/60 |

FOREIGN PATENT DOCUMENTS

| | | | |
|---|---|---|---|
| 836142 | 10/1938 | France | 418/59 |

*Primary Examiner*—Michael Koczo

*Attorney, Agent, or Firm*—Robert K. Youtie

[57] ABSTRACT

A scroll type fluid displacement apparatus wherein a pair of cooperating fluid compression scrolls discharge compressed air to a pair of cooperating fluid expansion scrolls which contain combustion of expanding fluid to drive the apparatus, the scrolls having their axes extending longitudinally of each other, and a carrier between the scroll pairs and carrying the adjacent scroll of each pair for movement relative to its mating scroll, the scrolls of one pair extending outwardly in one angular direction and the scrolls of the other pair extending outwardly in the other angular direction when viewed in the same direction.

5 Claims, 8 Drawing Figures

SCROLL TYPE FLUID DISPLACEMENT APPARATUS

BACKGROUND OF THE INVENTION

Examples of the prior art of scroll type fluid displacement apparatus are disclosed in the below listed U.S. Pat. Nos.:

| U.S. Pat. No. | Dated | Patentee |
|---|---|---|
| 801,182 | Oct 3, 1905 | L. Creux |
| 3,817,664 | June 18, 1974 | Bennett et al |
| 3,884,599 | May 20, 1975 | Young et al |
| 3,994,635 | Nov. 30, 1976 | McCullough |
| 4,129,405 | Dec. 12, 1978 | McCullough |
| 4,192,152 | Mar. 11, 1980 | Armstrong et al |
| 4,300,875 | Nov. 17, 1981 | Fischer et al |
| 4,343,599 | Aug. 10, 1982 | Kousokabe |
| 4,484,869 | Nov. 27, 1984 | Nakayama et al |
| 4,490,099 | Dec. 25, 1984 | Terauchi et al |
| 4,497,615 | Feb. 5, 1985 | Griffith |
| 4,505,651 | Mar. 19, 1985 | Terauchi et al |
| 4,515,539 | May 7, 1985 | Morishita |
| 4,550,480 | Nov. 5, 1985 | Tanikawa et al |

The prior art discloses such apparatus as employed to pump fluids, compress fluids, and also as motors or engines driven by fluids. However, the prior art makes no suggestion of a combined compressor and engine requiring only a single rotor, as for a supercharged internal combustion engine.

Further, while the prior art attempts to simplify the manufacture and structure of the scroll type apparatus, the parts thereof remain extremely expensive and time consuming in manufacture, which has seriously limited the use of such apparatus.

SUMMARY OF THE INVENTION

It is an object of the present invention to provide a supercharged internal combustion engine requiring only a single rotor for both compression of inlet air and expansion of combustion products to achieve an extremely simple and highly reliable engine construction.

It is another object of the present invention to provide a scroll type apparatus including a unique structure of scroll element and a highly simplified and economical method of manufacture of scroll element.

Other objects of the present invention will become apparent upon reading of the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

DESCRIPTION OF THE PREFERRED EMBODIMENTS

Figure 1:
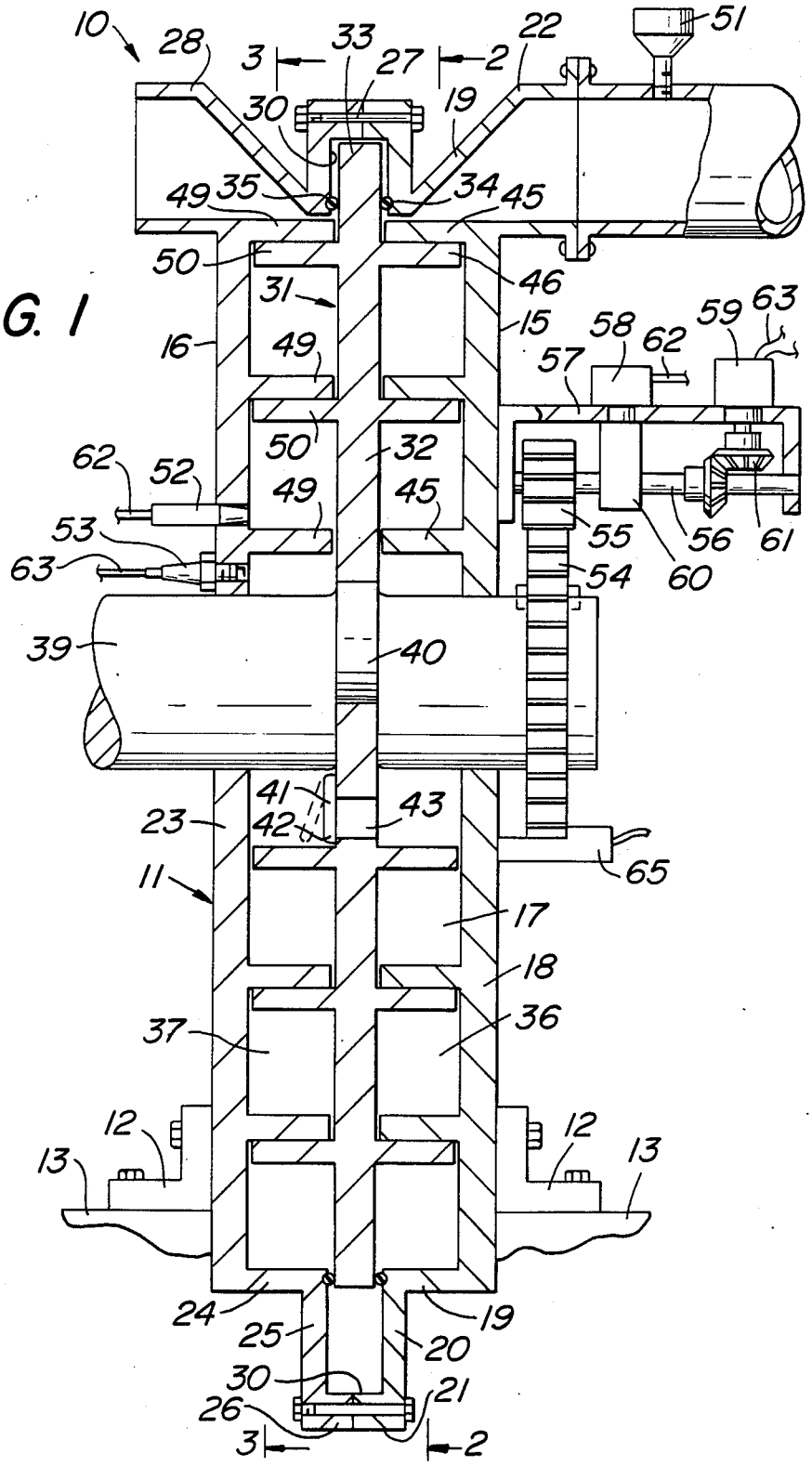
FIG. 1 is a transverse sectional view showing a scroll type apparatus constructed in accordance with the teachings of the present invention.
Figure 2:
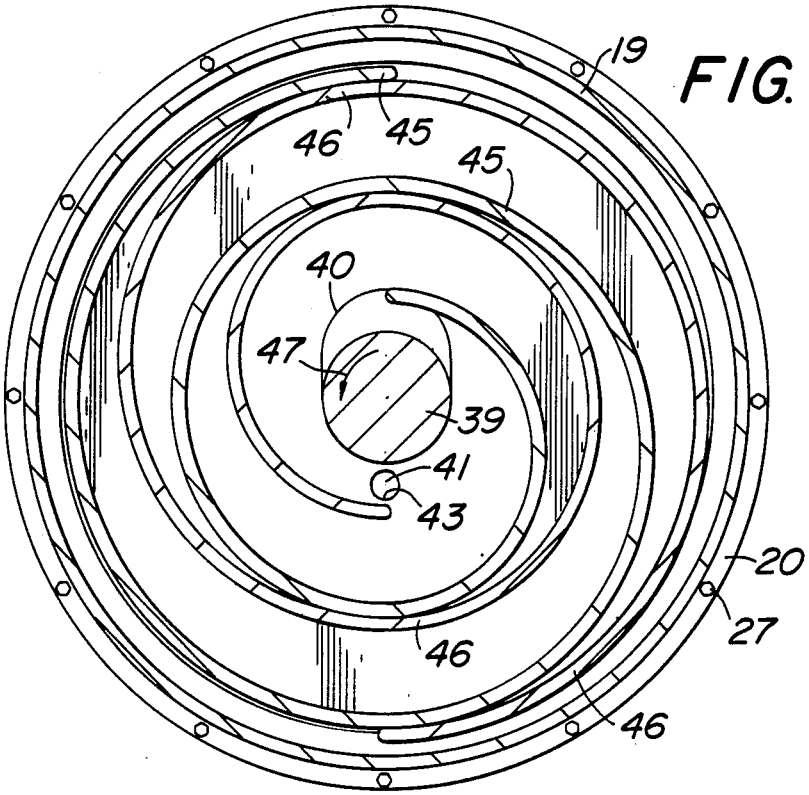
FIG. 2 is a sectional view taken generally along the line 2—2 of FIG. 1.
Figure 3:
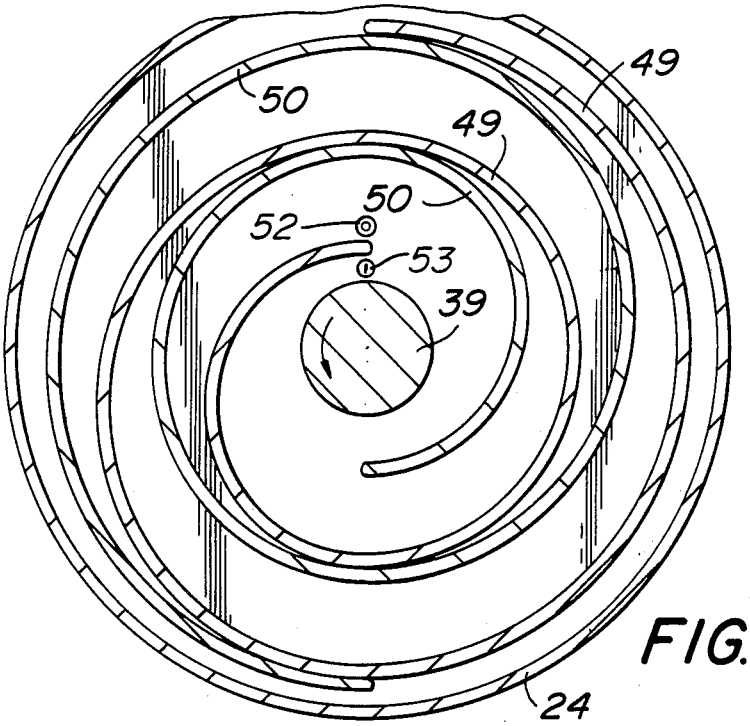
FIG. 3 is a sectional view taken generally along the line 3—3 of FIG. 1.

Referring now more particularly to the drawings, and specifically to FIGS. 1–3 thereof, a supercharged internal combustion engine is there generally designated 10, and may include a casing 11 suitably fixed, as by brackets 12 to a support 13.

The casing 11 may include a pair of complementary casing sections 16 and 15, which may each be generally cylindrical and in facing relation with each other to define a generally closed cylinder enclosing a generally cylindrical interior space 17. More specifically, the casing section 15 may include a generally flat, circular side wall 18 having an inwardly extending peripheral wall 19. Extending entirely along the inner edge of the peripheral wall 19 is a flange 20, radially outstanding beyond the peripheral wall, and provided on its outer edge with an inturned securement lip 21. At one location about the periphery of the side wall 15, the peripheral wall 19 is provided with an air inlet conduit 22 communicating between exterior and interior of the casing 11. The side wall 23 of casing section 16 is essentially similar to the casing wall 15, being generally flat and of circular configuration, having a peripheral, inwardly extending wall 24 provided on its inner edge with a circumferentially, radially outstanding flange 25, the radially outer edge of which is provided with a circumferentially extending inturned securement lip 26 in edge to edge relation with the securement lip 21 of casing section 15. The casing lips or securement edges 21 and 26 may be suitably secured, as by a circular array of bolts or fasteners 27, and suitably sealed, as by gasket means, as desired.

At one location about the peripheral wall 24 there may be provided a fluid outlet or exhaust conduit 28 communicating between the interior space 17 of the casing 11 and the exterior thereof.

The generally annular flanges 20 and 25 extend in facing, spaced relation with each other and combine with their inturned lips 21 and 26 to define an annular channel or groove 30 extending circumferentially about the cylindrically shaped casing 11 and opening radially into the interior hollow 17 of the casing.

A rotor is generally designated 31 and located interiorly of the casing 11. The rotor may include a generally flat, approximately circular plate 32 having its circumferential margin 33 extending into the channel 30 entirely thereabout. That is, the marginal edge portion 33 of the rotor plate or wall 32 extends into the circumferential casing groove or channel 30 entirely thereabout, but may terminate short of the channel lips 21 and 26 to permit of orbital movement of the rotor by rotary translation in the manner of scroll type apparatus, as will appear more fully hereinafter.

That is, the diameter of the rotor plate or wall 32 is less than the internal diameter groove 30 to permit of the orbital rotor motion. Suitable sealing means, such as O-rings or gaskets 34 and 35 may be interposed between the rotor plate 32 and channel walls 20 and 25, respectively. Thus, the rotor plate 32 may subdivide the interior 17 of the casing 11 into a pair of chambers 36 and 37 in side by side relation on opposite sides of the rotor. For reasons which will appear more fully hereinafter, the chamber 36 may be considered as the inlet or compression chamber, while the chamber 37 may be considered as the outlet or expansion chamber.

A crank shaft 39 is suitably journaled in the casing walls 18 and 23, and includes an eccentric or crank 40, in rotor wall 32. Thus, upon rotation of the crank shaft 39 the rotor 31 is caused to move about the axis of the crank shaft, moving eccentrically thereabout by the eccentric distance or throw of the crank 40. The rotor is limited to a translatory rotation or orbital movement, rather than pure rotation by any suitable means, such as the thrust bearing of Terauchi in U.S. Pat. No. 4,477,238, or the guide cranks of Fischer et al. in U.S. Pat. No. 4,300,875, or other.

Also, the wall or plate 32 of rotor 31 is provided, generally proximate to the crank shaft 39 with a one way valve 41, which may be a flap 42 over a port 43, or other suitable one way valve. The valve 41 will open under pressure differential to pass relatively high pressure fluid from the compression chamber 36 to the expansion chamber 37.

As is well known, scroll type fluid displacement apparatus includes a pair of generally identical spiral walls or wraps interfitting with each other and combining with each other and end plates or closures to define one or more closed pockets which move spirally and radially upon relative orbital movement between the spiral wraps. More particularly, a closed pocket moves radially inwardly and reduces in size, or moves radially outwardly and increases in size, depending upon both the direction of relative orbital movement and the orientation of the spiral wraps. For a given direction of relative orbital movement, a radially inwardly moving and compressing pocket may be caused to move radially outwardly and expand by reversing the orientation or direction of the spiral wraps.

Fixed on the internal surface of casing wall or end plate 18 is a spiral compression wrap or wall 45 having approximately two convolutions. An identical spiral wrap or wall 46 is fixed to and outstands from the rotor wall or end plate 32 into the compression chamber 36, being angularly offset approximately 180° from the wrap 45 and radially offset by the eccentric distance of crank 40. This is best seen in FIG. 2, where it will be appreciated that rotation of the crank shaft 39 in the direction of arrow 47 to orbit the moveable spiral wrap 46 counterclockwise as seen in FIG. 2, will result in the drawing of fluid inwardly through inlet passageway 22 into the radially outer regions of chamber 36, and thence by pocket reduction the hereinbefore described, radially inward fluid movement and compression. The valve 41 is selected to open under the pressure of compressed fluid and pass the same into chamber 37. Thus, it will be appreciated that the fixed and orbital wraps 45 and 46, respectively, may be considered as compression wraps, serving to compress air entering inlet conduit 22.

Extending into chamber 37 from casing end plate or wall 23, and fixed thereto, is a spiral wall or wrap 49, see FIG. 3. A similarly oriented spiral wall or wrap 50 is provided on and projects from the rotor end plate or wall 43 into the chamber 37. As best seen in FIG. 2, the spiral wraps 45 and 46 of chamber 36 are oriented in one angular direction, and the spiral wraps 49 and 50 in the chamber 37 are oriented in the opposite angular direction. Thus, upon rotation of the rotor 31, to effect orbital movement of the moveable spiral wraps 46 and 50 in the same angular direction, the cooperating pairs of spiral wraps will cooperate oppositely. As noted hereinbefore, the spiral wraps or walls 45 and 46 will compress fluid radially inwardly. Conversely, the spiral wraps 49 and 50 will expand fluid radially outwardly. That is, fluid entering the chamber 37 through port 43 will expand and move radially outwardly in chamber 37 for discharge through outlet 28. The spiral wraps 49 and 50 may therefore be aptly termed the fixed and moveable expansion spiral wraps, respectively.

Desirably the fluid or air entering in the conduit 22 may be provided with a lubricant, such as by oil dispenser or oiler 51 to lubricate and minimize wear on the contacting surfaces of the spiral wraps and end plates. Advantageously, the spiral wraps may be provided along their edges with suitable seals for engagement with the relatively moving end plates of the cooperating spiral wraps, such as in U.S. Pat. No. 4,477,238, or other.

At central locations in the end plate or wall 23 of section 16, there may be provided suitable combustion charge feeding means 52, say a fuel injector, and combustion charge igniting means 53, say a spark plug. A gear or geared flywheel 54 may be circumposed about and keyed to the crankshaft 39 for rotation therewith, and is shown in driving engagement, as by gear 55, with rotary shaft 56 which is mounted in a suitable bracket 57 fixed to the casing 11. The bracket 57 may also mount a fuel pump 58 and a distributor 59, which are respectively driven, as by driving means 60 and 61, by the shaft 56. The fuel pump 58 may be connected by conduit 62 to deliver fuel to injector 52, and the distributor 59 may be connected by conductors 63 to deliver spark to plug 53, in properly timed relation to effect combustion of a central charge in expansion chamber 37, which combustion causes expansion of the fluid to drive the rotor 31. This maintains operation of the engine 10 and, in addition, produces useful work at the shaft 39.

Also, fixed to the casing 11, as to wall 18, may be a starter motor 65 in meshing engagement with the gear 54 for initiating operation of the engine.

While the spiral wraps 45, 46, 49 and 50 have been illustrated as integral with their respective walls or end plates 18, 32 and 23, the actual construction is not integral or one piece, but fabricated of multiple pieces as shown in FIGS. 4–7.

Figure 4:
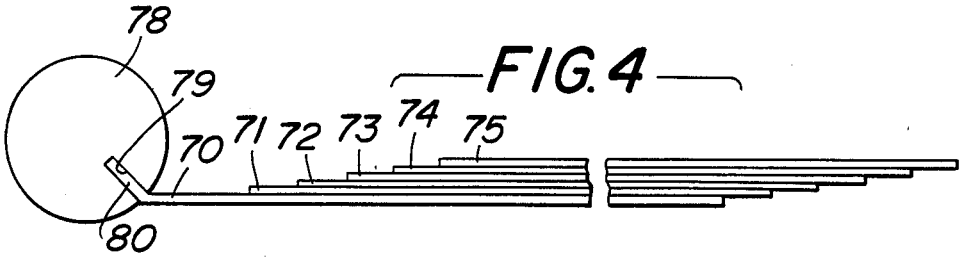
FIG. 4 is an end view illustrating an early stage in manufacture of a scroll element according to the instant invention.
Figure 5:
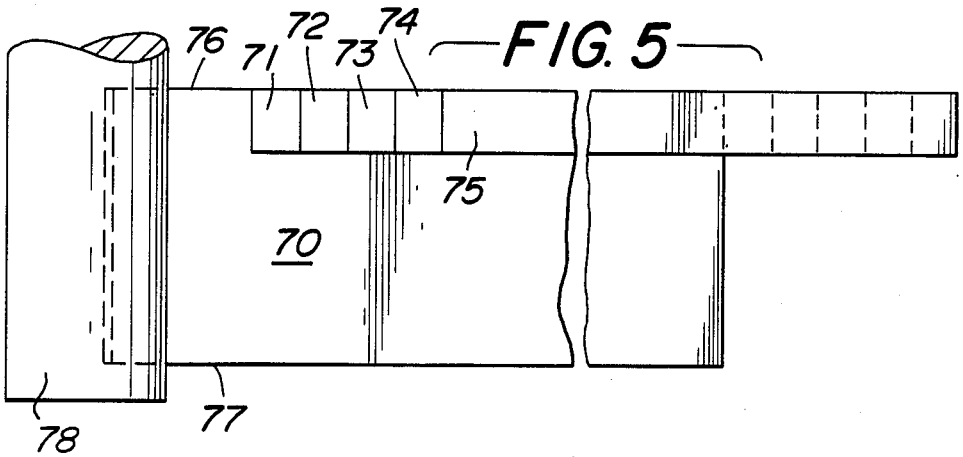
FIG. 5 is a plan view showing the manufacture according to FIG. 4.

In FIGS. 4 and 5 are illustrated an initial stage in manufacture of a scroll element, wherein a plurality of sheets, strips or laminations 70, 71, 72, 73, 74 and 75 are arranged in longitudinally extending relation with each other and are arranged in superposed or overlying, facing engagement. The lowermost, elongate sheet, strip or lamination 70 may be relatively wide, as between opposite side edges 76 and 77, while the remaining elongate strips or laminations 71–75 are of equal, relatively narrow width and superposed one above the other in laterally coextensive relation, all having one side edge extending along and coincident or flush with the side edge 76 of the wider strip 70. The several narrower strips 71–77 may be of generally equal length, and may be superposed one over the other in staggered or stepped relation, each successive upper strip having its leftward end spaced rightward from the leftward end of the next adjacent lower strip. Also, the several narrower strips may be spaced rightward from the leftward end of the lowermost, wider strip 70.

A core, roll or mandrel 78 may be formed with a longitudinally extending, radially outwardly opening slot 79 adapted to receive the leftward, free end portion 80 of the lowermost, wider strip 70. This is the condition shown in FIGS. 4 and 5.

Figure 6:
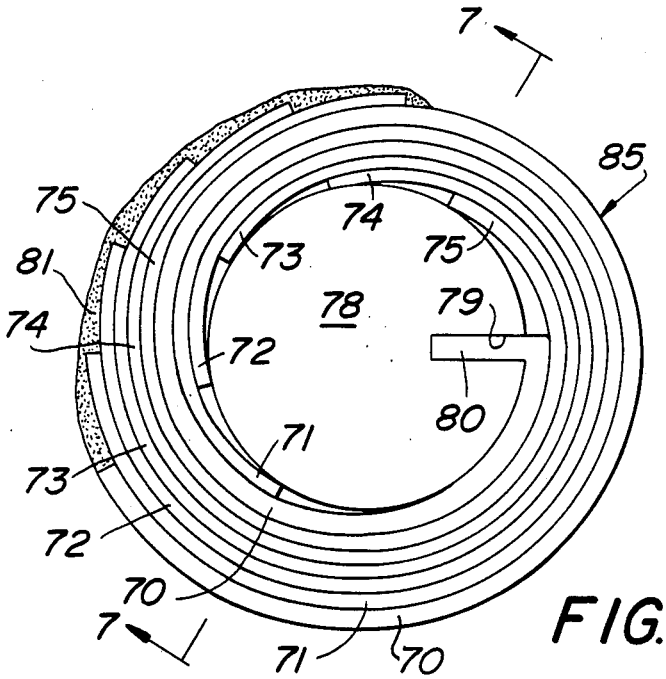
FIG. 6 is an end view showing a later stage in the instant method.

The cylindrical mandrel or core rod 78 may be rotated or rolled, generally clockwise as seen in FIG. 4 to wind the strips 70–75 about the mandrel, as shown in FIG. 6. Thus, the several strips 70–75 are tightly wound about the mandrel, each strip 71–75 having its entire radially outer surface in facing engagement with the next outer strip, except for the radially outer end portions. Also, the relatively wide strip 70 is spirally wound with its radially inner surface along its side edge 76 in intimate facing engagement with the next adjacent narrower strip 71, except for the innermost end region of the wider strip. In such configuration, each strip 70–75 defines a spiral having its adjacent convolutions spaced apart by the remaining strips. In particular, the spiral convolution defined by the wider strip 70 is illustrated as extending angularly approximately 500°, to define a partial second convolution of approximately 140°. The overlapping portions of convolutions of strip 70 are spaced apart a constant distance by the interposed laminations of narrower strips 71–75.

The wound assemblage of FIG. 6 may be fixedly secured together in its wound or spiral configuration by any suitable means, such as a weld 81 on the outer periphery of the spiral winding, say securing together the end portions of the several strips 70–75 to prevent unwinding of the strips.

Figure 7:
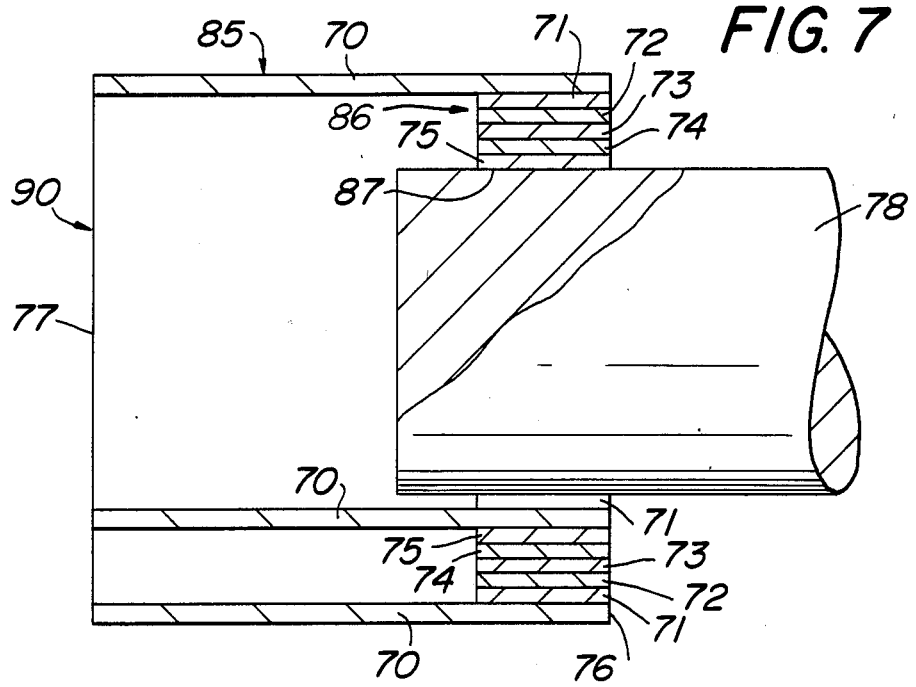
FIG. 7 is a sectional view taken generally along the line 7—7 of FIG. 6.

From FIGS. 6 and 7 it will be understood that a scroll element is provided, generally designated 85, fabricated of the several laminations 70–75 wherein the laminations 71–75 and the adjacent portions of lamination 70 are all in overlying facing engagement with each other having one edge generally coplanar and combine to define an end wall or plate 86 generally normal to and closely surrounding the mandrel or core 78. The mandrel or core 78 may be longitudinally withdrawn for removal to leave a central opening 87, which may be suitably filled or closed, as desired.

The remaining portion of lamination 70 extends beyond the end wall 86 and has its edge 77 generally coplanar and located beyond the strips or layers 71–75 of end wall or plate 86. By this extension of relatively wide strip or sheet 70 beyond the relatively narrow laterally coextensive sheets or strips 71–75, the wider strip 70 defines a spiral wrap 90 outstanding from the end wall 86. A pair of such scroll elements 85 may be arranged with their end walls 86 in parallel spaced, facing relation and their spiral wraps 90 in interfitting relation, and mounted for relative orbital motion to provide a scroll type fluid displacement apparatus.

Of course, the laminations 71–75 may be more or less in number and of any preferred thickness to achieve a desired spacing between convolutions or partial convolutions of the spiral wrap 90. Also, the spiral wrap may be of more than one lamination, if desired.

Figure 8:
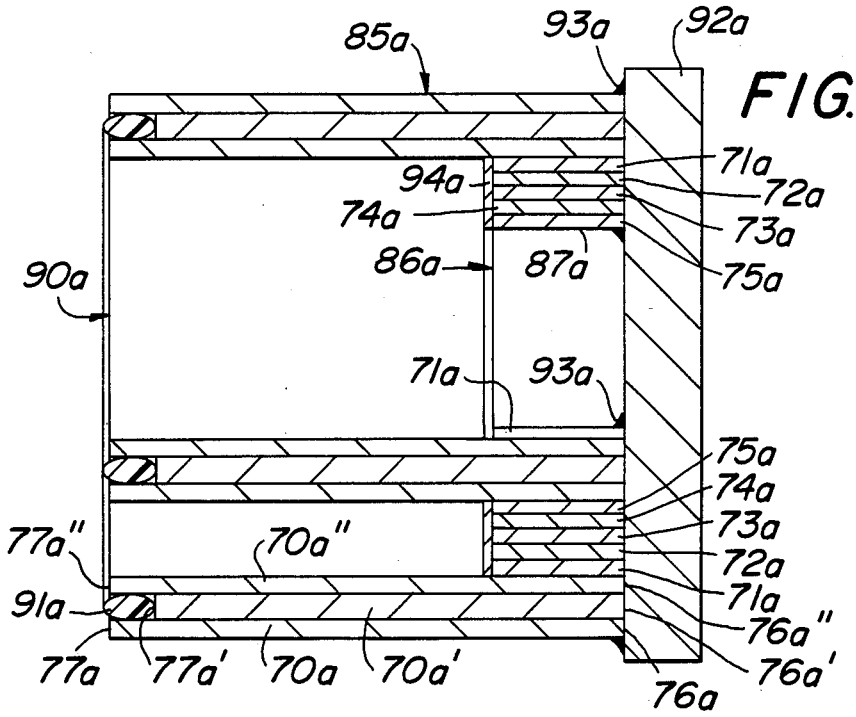
FIG. 8 is a sectional view similar to FIG. 7, but showing a slightly modified embodiment of the present invention.

For example in FIG. 8, a scroll element **85*a* is similar to the scroll element 85 including a plurality of relatively narrow laminations 71*a*, 72*a*, 73*a*, 74*a* and 75*a* spirally wound with adjacent convolutions in facing engagement with each other. Additionally there may be a plurality of relatively wide laminations 70*a*, 70*a*′, 70*a*″ in facing engagement with each other and spirally wound together with the narrow laminations. The wide laminations may have one longitudinal edge generally coplanar with each other and the outer longitudinal edges of the narrow laminations. That is, the wide laminations 70*a*, 70*a*′ and 70*a*″ may have their respective edges 76*a*, 76*a*′ and 76*a*″ generally coplanar or flush with each other and with the outer edges of the narrow laminations 71*a*, 72*a*, 73*a*, 74*a* and 75*a*. As the laminations 70*a*, 70*a*′ and 70*a*″ are wider than the narrow laminations, they extend beyond the latter to terminate at 77*a*, 77*a*′ and 77*a*″**, beyond the narrow laminations.

Thus, it will be appreciated that the multiple laminations **70*a*, 70*a*′ and 70*a*″ define a spiral wrap, generally designated 90*a* on an end plate or wall 86*a* corresponding to the spiral wrap 90 of FIG. 7 on the end plate or wall 86**.

In addition, the spiral wrap **90*a* may have its intermediate lamination 70*a*′ terminating at an edge 77*a*′ short of the edges 77*a* and 77*a*″ of laminations 70*a* and 70*a*″. In this manner, the edges 77*a*, 77*a*′ and 77*a*″ combine to define an end groove, as for receiving a sealing element 91*a*** for sealing engagement with a complementary scroll element.

Also, scroll element **85*a* of FIG. 8 illustrates the central opening 87*a* as closed by a generally flat plate or wall 92*a* suitably secured by welds 93*a* to the flush or conincident edges of the several laminations. If desired, a generally flat, but spirally configured sheet or plate 94*a* may be suitably secured on the inner coincident edges of the narrower laminations 71*a*, 72*a*, 73*a*, 74*a* and 75*a***, as for bearing engagement with the seal element of a mating scroll element.

From the foregoing, it is seen that the present invention provides a scroll type fluid displacement apparatus and method of manufacture which are extremely simple and advantageous in construction and operation, and fully accomplish their intended objects.

Although the present invention has been described in some detail by way of illustration and example for purposes of clarity of understanding, it is understood that certain changes and modifications may be made within the spirit of the invention.

What is claimed is:

1. A scroll type apparatus comprising a casing having a gas inlet chamber and a gas exhaust chamber in side by side relation, a fixed compression spiral wrap in said inlet chamber facing toward said exhaust chamber, a fixed expansion spiral wrap in said exhaust chamber facing toward said inlet chamber, orbital carrier means interposed between and having opposite sides facing toward respective fixed spiral wraps, carrier means mounting means mounting said carrier means for orbital movement relative to said fixed spiral wraps, a moveable compression spiral wrap on one side of said carrier means interfitting with and orbitally moveable relative to said fixed compression spiral wrap, a moveable expansion spiral wrap on the other side of said carrier means interfitting with and orbitally moveable relative to said fixed expansion spiral wrap, said compression spiral wraps being oriented in one angular direction to compress gas in said inlet chamber and displace compressed gas inwardly upon said orbital carrier means movement, and said expansion spiral wraps being oriented in the other angular direction to expand gas and displace it radially outwardly into said exhaust chamber upon orbital carrier means movement, port means centrally of said carrier means communicating between said inlet and exhaust chambers for passing compressed gas from said compression spiral wraps to said expansion spiral wraps, and combustion charge means communicating with said expansion spiral wraps for ignition to expand gas in said expansion sprial wraps and drive said carrier and mounting means.

2. Apparatus according to claim 1, said carrier means extending across said casing and subdividing the interior of said casing into said inlet and exhaust chambers.

3. Apparatus according to claim 1, in combination with one-way valve means associated with said port means for passing gas from said compression wraps to said expansion wraps.

4. A scroll type apparatus comprising a pair of relatively fixed spaced outer walls, an inner wall spaced between said outer walls, a pair of outer scrolls respectively carried by said pair of outer walls extending inwardly to opposite sides of said inner wall, a pair of inner scrolls carried on opposite sides of said inner wall each extending outwardly to the adjacent outer wall in interpenetrating tangentially contacting relation with the adjacent outer scroll to define an enclosed space between each of said pair of interpenetrating scrolls, mounting means mounting said inner and outer scrolls for orbital relative movement with said interpenetrating scrolls in said contacting relation, said pairs of interpenetrating scrolls being oppositely oriented so that one enclosed space reduces and moves radially inwardly and the other enclosed space enlarges and moves radially outwardly upon said orbital relative movement in one direction, a radially outer fluid entry for passing fluid to said one enclosed space for compression, a radially inner fluid passageway between said enclosed spaces for passing compressed fluid from said one enclosed space to said other enclosed space for expansion therein, a radially outer fluid discharge for passing expanded fluid from said other enclosed space, and combustion charge means communicating with said other enclosed space before full enlargement thereof to expand fluid therein and drive said mounting means in its orbiting relative movement.

5. An internal combustion engine comprising a scroll expander operable to expand a central pocket moving spirally outwardly, a compressor communicating centrally with the pocket of said expander for feeding to the latter a compressed gas to be expanded, and combustion charge means communicating with the pocket of said expander for ignition therein, said compressor comprising a scroll compressor, said scroll expander and scroll compressor each comprising a fixed spiral wrap, a cooperating orbital spiral wrap, said orbital spiral wrap of said expander and compressor being in adjacent back-to-back relation, said fixed spiral wraps of said expander and compressor being in spaced apart facing relation on opposite sides of said orbital wraps, and a single rotor interposed between said carrying said orbital wraps in their orbital motion, said rotor having a central passageway for communication between said compressor and expander.

* * * * *